US010450843B2

(12) United States Patent
Malbrel

(10) Patent No.: US 10,450,843 B2
(45) Date of Patent: Oct. 22, 2019

(54) SCREEN ASSEMBLY FOR A RESOURCE EXPLORATION SYSTEM

(71) Applicant: Christophe Malbrel, Houston, TX (US)

(72) Inventor: Christophe Malbrel, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 396 days.

(21) Appl. No.: 15/174,464

(22) Filed: Jun. 6, 2016

(65) Prior Publication Data

US 2017/0350218 A1 Dec. 7, 2017

(51) Int. Cl.
*E21B 33/12* (2006.01)
*E21B 43/08* (2006.01)

(52) U.S. Cl.
CPC ..... *E21B 43/086* (2013.01); *E21B 33/12* (2013.01)

(58) Field of Classification Search
CPC ..... E21B 43/08; E21B 33/12; E21B 43/086; E21B 43/10; E21B 43/103; E21B 33/1208; E21B 33/1277; E21B 43/12
See application file for complete search history.

(56) References Cited

U.S. PATENT DOCUMENTS 5,183,110 A 2/1993 Logan et al.
7,661,476 B2 * 2/2010 Yeh ..... E21B 17/02 166/278
8,286,704 B2 * 10/2012 Chan ..... E21B 43/12 166/227
2003/0234111 A1 12/2003 Echols et al.
2008/0283240 A1 11/2008 Baaijens et al.
2009/0218101 A1 * 9/2009 Langlais ..... E21B 33/122 166/313
2011/0036565 A1 2/2011 Holderman et al.
2011/0073308 A1 * 3/2011 Assal ..... E21B 43/08 166/278
2011/0203793 A1 * 8/2011 Tibbles ..... E21B 43/04 166/278
2013/0008652 A1 1/2013 Broussard et al.
(Continued)

FOREIGN PATENT DOCUMENTS

WO 2017213773 12/2017

OTHER PUBLICATIONS

Carrejo, Nick, "Completion & Production: Bonded Bead Screen Sizing for Formation Sand Control", Baker Hughes Incorporated, Apr. 11, 2016, Revision 2, 4 pages.
(Continued)

*Primary Examiner* — Daniel P Stephenson
(74) *Attorney, Agent, or Firm* — Cantor Colburn LLP

(57) ABSTRACT

A screen assembly includes a tubular having a first end, a second end, and an intermediate portion including an outer surface provided with a plurality of openings extending therebetween. At least one screen arranged at the plurality of openings. At least two deformable members are mounted to the tubular between the first end and the second end. The at least two deformable members are selectively radially outwardly expandable relative to the at least one screen forming a plurality of screen compartments on the tubular, the plurality of screen compartments being substantially fluidically isolated from one another externally of the tubular.

17 Claims, 6 Drawing Sheets

(56) References Cited

U.S. PATENT DOCUMENTS

| | | | | |
|---|---|---|---|---|
| 2013/0248178 | A1* | 9/2013 | Hecker | E21B 33/12 166/278 |
| 2015/0300133 | A1* | 10/2015 | Songire | E21B 43/108 166/276 |
| 2016/0017697 | A1* | 1/2016 | Di Pietro | E21B 43/08 166/308.1 |
| 2016/0040515 | A1* | 2/2016 | Yeh | E21B 43/08 166/373 |
| 2017/0350218 | A1* | 12/2017 | Malbrel | E21B 33/12 |
| 2017/0350219 | A1 | 12/2017 | Mabrel | |

OTHER PUBLICATIONS

Notification of Transmittal of the International Search Report and the Written Opinion of the International Searching Authority; PCT/US2017/030998; dated Aug. 2, 2017; 13 pages.

* cited by examiner

SCREEN ASSEMBLY FOR A RESOURCE EXPLORATION SYSTEM

BACKGROUND

During various downhole operations there may be a need to control sand and/or other debris entrained with downhole fluids. Sand screens may be provided about a tubular having inlet openings that receive downhole fluids. The sand screens may include one or more layers each having gradually increasing opening sizes with an outer most screen layer including openings that are smaller than an innermost screen layer. Over time, produced sand impinges on screen surface causing erosion and/or clogging of the sand screen that could lead to screen failure.

SUMMARY

A screen assembly includes a tubular having a first end, a second end, and an intermediate portion including an outer surface provided with a plurality of openings extending therebetween. At least one screen arranged at the plurality of openings. At least two deformable members are mounted to the tubular between the first end and the second end. The at least two deformable members are selectively radially outwardly expandable relative to the at least one screen forming a plurality of screen compartments on the tubular, the plurality of screen compartments being substantially fluidically isolated from one another externally of the tubular.

A resource exploration system includes a surface portion, and a downhole portion having a plurality of tubulars, and a screen assembly connected to one of the plurality of tubulars. The screen assembly includes a tubular having a first end coupled to the one of the plurality of tubulars, a second end, and an intermediate portion including an outer surface provided with a plurality of openings extending therebetween. At least one screen is arranged at the plurality of openings. At least two deformable members are mounted to the tubular between the first end and the second end. The at least two deformable members are selectively radially outwardly expandable relative to the at least one screen forming a plurality of screen compartments on the tubular.

BRIEF DESCRIPTION OF THE DRAWINGS

Referring now to the drawings wherein like elements are numbered alike in the several Figures.

DETAILED DESCRIPTION

Figure 1:
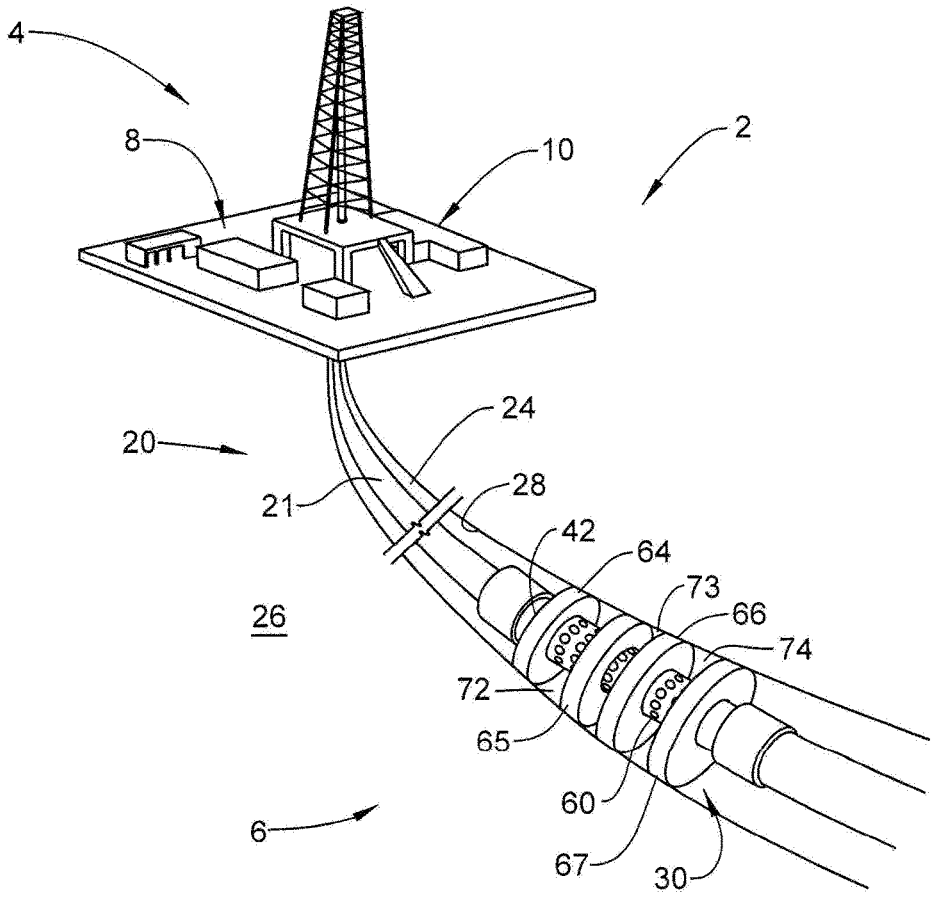
FIG. 1 depicts a resource exploration system including a screen assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole portion 4 operatively connected to a downhole portion 6. Uphole portion 4 may include pumps 8 that aid in completion and/or extraction processes as well as fluid storage 10. Fluid storage 10 may contain a gravel pack fluid or slurry (not shown) that is introduced into downhole portion 6.

Downhole portion 6 may include a downhole string 20 formed from a plurality of tubulars, one of which is indicated at 21 that is extended into a wellbore 24 formed in formation 26. Wellbore 24 includes an annular wall 28 that may be defined by formation 26. It is to be understood that annular wall 28 may also be defined by a casing. One of tubulars 21 may be connected with a screen assembly 30. Screen assembly 30 filters out or blocks various particles from entering downhole string 20 during select downhole operations.

Figure 2:
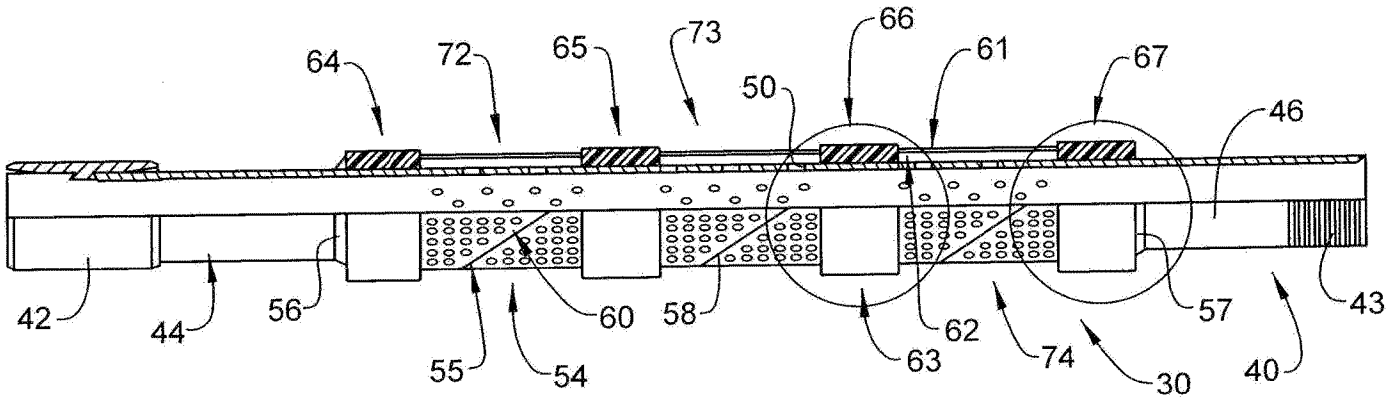
FIG. 2 depicts a partial cross-sectional side view of the screen assembly of FIG. 1.
Figure 4:
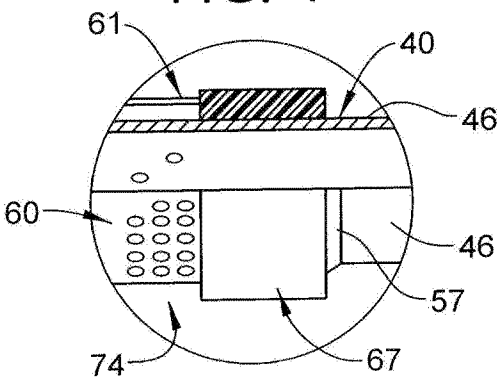
FIG. 4 depicts a detail view of another portion of the screen assembly of FIG. 2.
Figure 3:
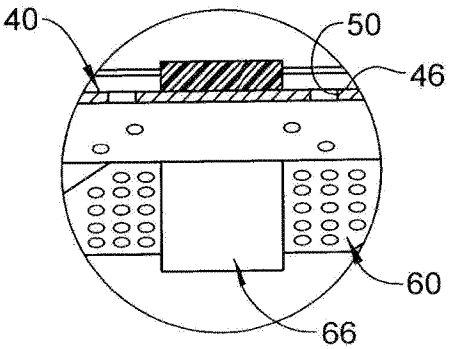
FIG. 3 depicts a detail view of a portion of the screen assembly of FIG. 2.

With reference to FIGS. 2-4 screen assembly 30 includes a tubular 40 having a first or box end 42, a second or pin end 43 and an intermediate portion 44 having an outer surface 46 extending therebetween. Tubular 40 includes a plurality of openings 50 that extend through outer surface 46. A screen 54 is provided on tubular 40. Screen 54 defines an annular screen 55 that extends over each of the plurality of openings 50. Annular screen 55 includes a first end portion 56, a second end portion 57, and an intermediate zone 58. Annular screen 55 includes a plurality of screen openings, one of which is indicated at 60. Plurality of screen openings 60 extend from an outer surface 61 of annular screen 55 through intermediate zone 58 to an inner surface 62.

In accordance with an aspect of an exemplary embodiment, screen assembly 30 includes a plurality of deformable members depicted as swellable members 63 arranged on outer surface 61 of annular screen 55. Plurality of swellable members 63 includes a first swellable member 64, a second swellable member 65, a third swellable member 66 and a fourth swellable member 67. First swellable member 64 is arranged at first end portion 56 of annular screen 55 adjacent to first end 42 of tubular 40. Fourth swellable member 67 is arranged at second end portion 56 of annular screen 55 adjacent second end 43 of tubular 40. Second and third swellable members 65 and 66 are arranged along intermediate zone 58 of annular screen 55. It is to be understood that the number of swellable members may vary.

In further accordance with an exemplary embodiment, swellable members 64-67 are selectively radially outwardly swellable to engage with wall 28 of wellbore 24. Once engaged, swellable members 64-67 form a first screen compartment 72, a second screen compartment 73, and a third screen compartment 74. Screen compartments 72-74 are fluidically isolated from one another externally of tubular 40. In this manner, in the event that a portion of screen 54 becomes clogged or otherwise fails to pass fluids, other portions of screen 54 may remain operational. The development of screen compartments 72-74 mitigate risks associated with erosion and plugging by reducing exposure to small sections of screen 54 that may be covered rapidly while other areas of screen 54 remain open and unobstructed.

Figure 5:
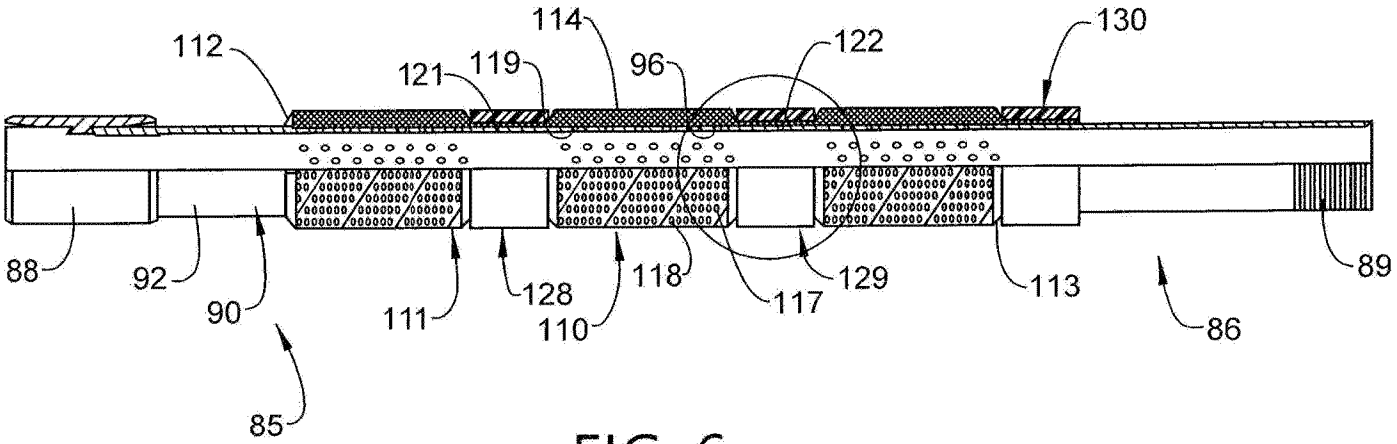
FIG. 5 depicts a partial cross-sectional side view of a screen assembly, in accordance with another aspect of an exemplary embodiment.
Figure 6:
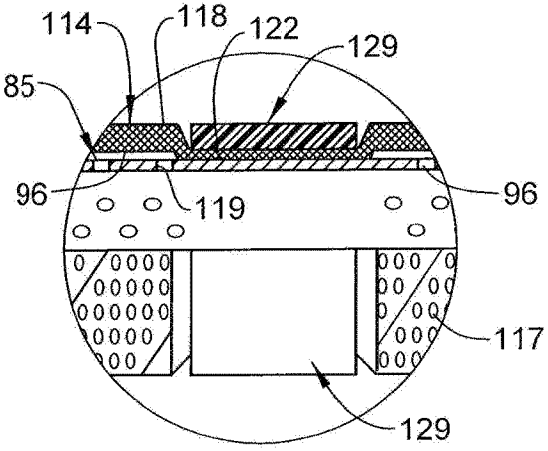
FIG. 6 depicts a detail view of a portion of the screen assembly of FIG. 5.

Reference will follow to FIGS. 5 and 6 in describing a screen assembly 85 in accordance with another aspect of an exemplary embodiment. Screen assembly 85 includes a tubular 86 having a first end 88, a second end 89 and an intermediate portion 90 including an outer surface 92 extending therebetween. Tubular 86 includes a plurality of openings 96 that extend through outer surface 92. A screen 110 is provided on tubular 86. Screen 110 defines an annular screen 111 that extends over each of the plurality of openings 92. Annular screen 111 includes a first end portion 112, a second end portion 113, and an intermediate zone 114. Annular screen 111 includes a plurality of screen openings, one of which is indicated at 117. Plurality of screen openings 117 extend from an outer surface 118 of annular screen 111 through intermediate zone 114 to an inner surface 119.

Annular screen 111 further includes a first swaged zone 121 and a second swaged zone 122. Each swaged zone 121, 122 represents an area of annular screen 1112 in which inner surface 119 has been compressed toward outer surface 92 of tubular 86. In accordance with an aspect of an exemplary embodiment, inner surface 119 of annular screen 111 directly abuts outer surface 92 of tubular 86. It is to be understood that the number of swaged zones may vary.

In further accordance with an exemplary aspect, screen assembly 85 includes a first swellable member 128 that extends about annular screen 111 at first swaged zone 121, a second swellable member 129 that extends about annular screen 111 at second swaged zone 122 and a third swellable member 130 that extends about outer surface 92 of tubular 86 at second end portion 113 of annular screen 111. It is to be understood that the number of swellable members may vary. In a manner similar to that described above, swellable members 128-130 are selectively radially outwardly expandable to abut wall 28 creating a number of screen compartments (not separately labeled) that are fluidically isolated from one another externally of tubular 86.

Figure 7:
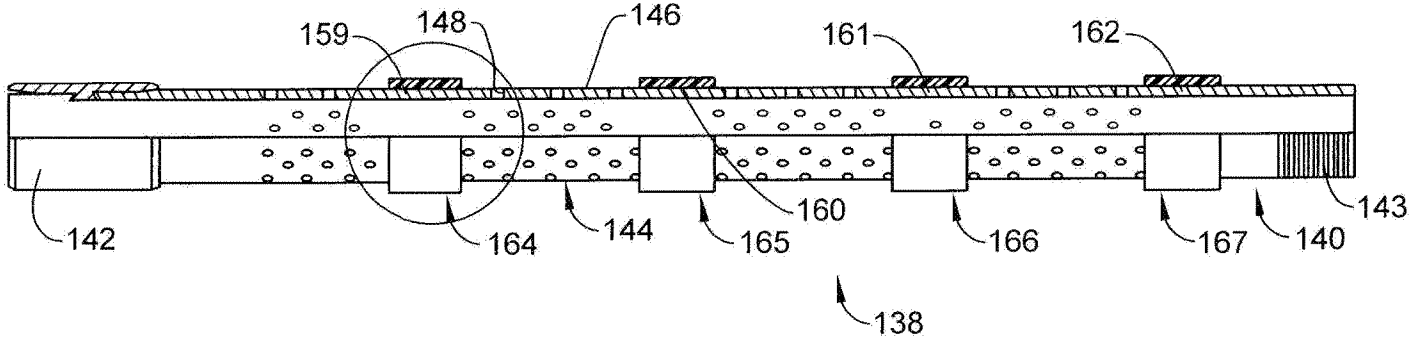
FIG. 7 depicts a partial cross-sectional view of a screen assembly, in accordance with another aspect of an exemplary embodiment.
Figure 8:
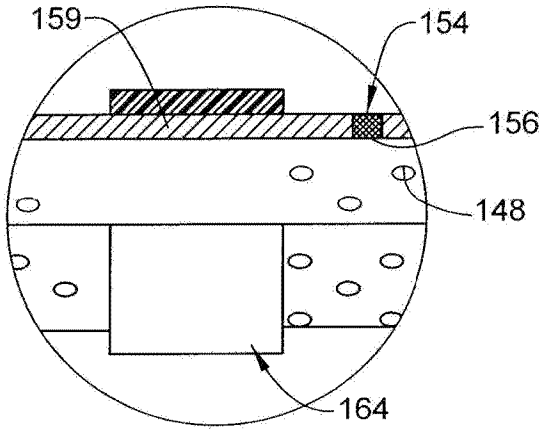
FIG. 8 depicts a detail view of a portion of the screen assembly of FIG. 7.

Reference will now follow to FIGS. 7 and 8 in describing a screen assembly 138 in accordance with another aspect of an exemplary embodiment. Screen assembly 138 includes a tubular 140 having a first end 142, a second end 143 and an intermediate portion 144 having an outer surface 146 extending therebetween. Tubular 140 includes a plurality of openings 148 that extend through outer surface 146. A plurality of screens, shown in the form of screen members, one of which is indicated at 154 is arranged in corresponding ones of the plurality of openings 148 in tubular 140. Screen members 154 filter fluid flowing through plurality of openings 148 and may take the form of sintered beads 156. It is to be understood that screen members 154 may also take the form of a welded mesh and/or consolidated gravel.

In accordance with an aspect of an exemplary embodiment, tubular 140 may include a first opening-free zone 159, a second opening-free zone 160, a third opening-free zone 161 and a fourth opening-free zone 162. Each opening-free zone 159-162 defines a section of intermediate portion 144 that is devoid of openings. In further accordance with an exemplary aspect, a first swellable member 164 is arranged at and extends about first opening-free zone 159. A second swellable member 165 is arranged at and extends about second opening-free zone 160; a third swellable member 166 is arranged at and extends about third opening-free zone 161, and a fourth swellable member 167 is arranged at and extends about fourth opening-free zone 162. In a manner similar to that described above, swellable members 164-167 are selectively radially outwardly expandable to abut wall 28 creating a number of screen compartments (not separately labeled) that are fluidically isolated from one another externally of tubular 140.

Figure 9:
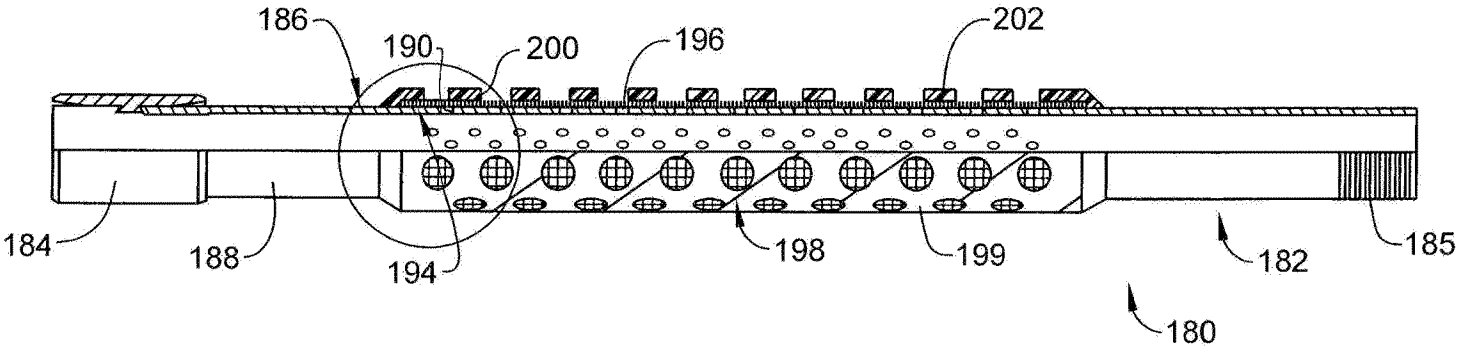
FIG. 9 depicts a screen assembly, in accordance with yet another aspect of an exemplary embodiment.
Figure 11:
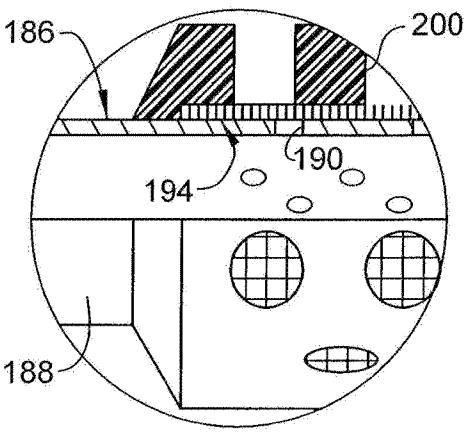
FIG. 11 depicts a detail view of a portion of the screen assembly of FIG. 9, showing a deformable member in a second configuration.
Figure 10:
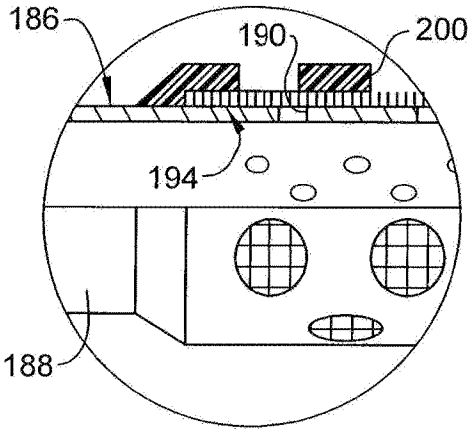
FIG. 10 depicts a detail view of a portion of the screen assembly of FIG. 9 showing a deformable member in a first configuration.

Reference will now follow to FIGS. 9-11 in describing a screen assembly 180 in accordance with yet another aspect of an exemplary embodiment. Screen assembly 180 includes a tubular 182 having a first end 184, a second end 185 and an intermediate portion 186 having an outer surface 188 extending therebetween. Tubular 182 includes a plurality of openings 190 that extend through outer surface 188. A screen 194 extends over tubular 182. Screen 194 may take the form of an annular screen 196 that extend about intermediate portion 186.

In accordance with an exemplary aspect, screen assembly 180 includes a swellable member 198 that extends across and about intermediate portion 186 across each of the plurality of openings 190. Swellable member 198 includes an outer surface 199 and a plurality of passages 200 defined by portions 202 of outer surface 199. Passages 200 register with the plurality of openings 190 creating a fluid pathway into an interior portion (not separately labeled) of tubular 182. In a manner similar to that described above, swellable member 198 selectively radially outwardly expands such that outer surface 199 abuts wall 28. Each of the plurality of passages 200 forms a discrete screen compartment (not separately labeled) that is fluidically isolated from other screen compartments externally of tubular 140.

Figure 12:
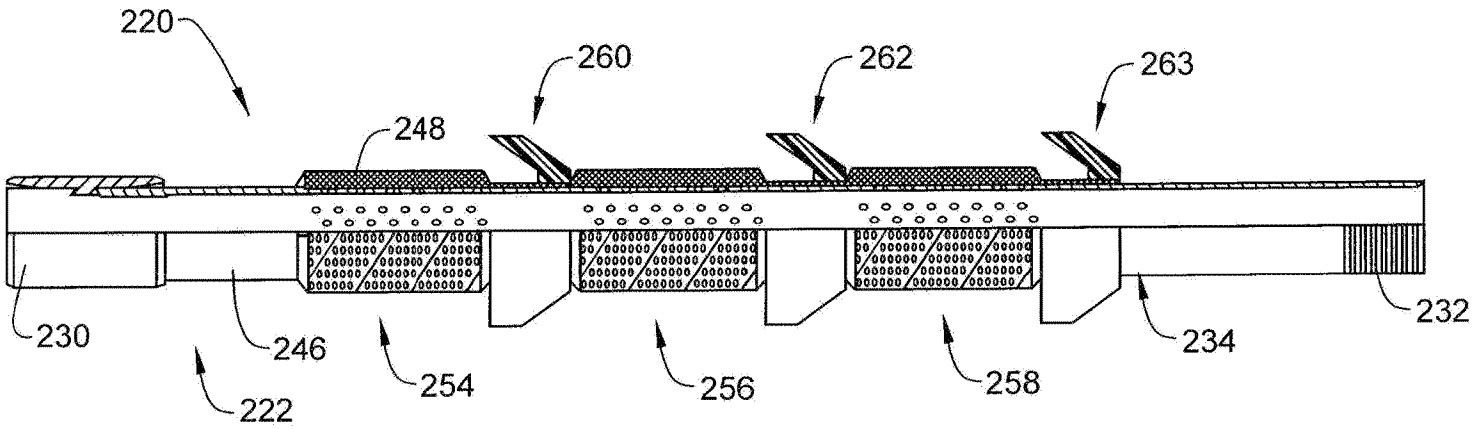
FIG. 12 depicts a partial cross-sectional view of a screen assembly, in accordance with still yet another aspect of an exemplary embodiment.

Reference will now follow to FIG. 12 in describing a screen assembly 220 in accordance with another aspect of an exemplary embodiment. Screen assembly 220 includes a tubular 222 having a first end 230, a second end 232 and an intermediate portion 234 having an outer surface 246 extending therebetween. Tubular 222 includes a plurality of openings 248 that extend through outer surface 246. A first screen 254 is positioned on outer surface 246 across openings 248, a second screen 256 is positioned on outer surface 246 spaced from first screen 254 and a third screen 258 is positioned on outer surface 246 spaced from second screen 256. It is to be understood that the number of screens may vary.

In further accordance with an exemplary aspect, screen assembly 220 includes a first deformable member 260 that extends about tubular 222 between first screen 254 and second screen 256, a second deformable member 262 that extends about tubular 222 between second screen 256 and third screen 258 and a third deformable member 263 that extends about tubular 222 adjacent third screen 258. It is to be understood that the number of swellable members may vary. In a manner similar to that described above, deformable members 260, 262, and 263 are selectively radially outwardly deformable creating a number of screen compartments (not separately labeled) that are fluidically isolated from one another externally of tubular 222. For example, deformable members 260, 262, and 263 may be expanded upon the shifting of tubular 222 relative to formation 26.

Embodiment 1

A screen assembly comprising: a tubular including a first end, a second end, and an intermediate portion including an outer surface provided with a plurality of openings extending therebetween; at least one screen arranged at the plurality of openings; and at least two deformable members mounted to the tubular between the first end and the second end, the at least two deformable members being selectively radially outwardly expandable relative to the at least one screen forming a plurality of screen compartments on the tubular, the plurality of screen compartments being substantially fluidically isolated from one another externally of the tubular.

Embodiment 2

The screen assembly according to any prior embodiment, wherein the at least one screen includes an annular screen extending about the tubular, the annular screen including an outer surface section and an inner surface section.

Embodiment 3

The screen assembly according to any prior embodiment, wherein at least one of the at least two deformable members is mounted to the outer surface section of the annular screen.

Embodiment 4

The screen assembly according to any prior embodiment, wherein the annular screen includes at least one swaged zone with the inner surface section of the annular screen abutting the outer surface of the tubular.

Embodiment 5

The screen assembly according to any prior embodiment wherein the at least one of the at least two deformable members is arranged on the annular screen at the at least one swaged zone.

Embodiment 6

The screen assembly according to any prior embodiment, wherein the at least two deformable members comprises portions of a deformable member extending between the first and second ends across all of the plurality of openings.

Embodiment 7

The screen assembly according to any prior embodiment, wherein the portions of the deformable member define a plurality of passages that register with corresponding ones of the plurality openings.

Embodiment 8

The screen assembly according to any prior embodiment, wherein the at least one screen includes a plurality of screen members arranged in corresponding ones of the plurality of openings.

Embodiment 9

The screen assembly according to any prior embodiment, wherein the plurality of screen members comprise at least one of a welded mesh, sintered beads and consolidated gravel.

Embodiment 10

The screen assembly according to any prior embodiment, wherein the at least two deformable members comprises at least three deformable members.

Embodiment 11

A resource exploration system comprising: an uphole portion; and a downhole portion including a plurality of tubulars, and a screen assembly connected to one of the plurality of tubulars, the screen assembly comprising: a tubular including a first end coupled to the one of the plurality of tubulars, a second end, and an intermediate portion including an outer surface provided with a plurality of openings extending therebetween; at least one screen arranged at the plurality of openings; and at least two deformable members mounted to the tubular between the first end and the second end, the at least two deformable members being selectively radially outwardly expandable relative to the at least one screen forming a plurality of screen compartments on the tubular.

Embodiment 12

The resource exploration system according to any prior embodiment, wherein the at least one screen includes an annular screen extending about the tubular, the annular screen including an outer surface section and an inner surface section.

Embodiment 13

The resource exploration system according to any prior embodiment, wherein at least one of the at least two deformable members is mounted to the outer surface section of the annular screen.

Embodiment 14

The resource exploration system according to any prior embodiment, wherein the annular screen includes at least one swaged zone with the inner surface section of the annular screen abutting the outer surface of the tubular.

Embodiment 15

The resource exploration system according to any prior embodiment, wherein at least one of the at least two deformable members is arranged on the annular screen at the at least one swaged zone.

Embodiment 16

The resource exploration system according to any prior embodiment, wherein the at least two deformable member comprises portions of a deformable member extending between the first and second ends across all of the plurality of openings.

Embodiment 17

The resource exploration system according to any prior embodiment, wherein the portions of the deformable member define a plurality of passages that register with corresponding ones of the plurality openings.

Embodiment 18

The resource exploration system according to any prior embodiment, wherein the at least one screen includes a plurality of screen members arranged in corresponding ones of the plurality of openings.

Embodiment 19

The resource exploration system according to any prior embodiment, wherein the plurality of screen members comprise at least one of a welded mesh, sintered beads and consolidated gravel.

Embodiment 20

A method of deploying a screen assembly comprising: deploying a screen assembly including at least one screen coupled to a tubular; expanding at least two deformable members radially outwardly relative to the at least one screen toward a formation; and creating a plurality of screen compartments on the tubular with the at least two deformable members.

Embodiment 21

The method of any prior embodiment, wherein creating the plurality of screen compartments includes creating a plurality of substantially fluidically isolated pockets externally of the tubular.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A screen assembly comprising:

a tubular including a first end, a second end, and an intermediate portion including an outer surface provided with a plurality of openings extending therebetween;

an annular screen extending about the tubular and arranged at the plurality of openings, the annular screen including an outer surface section and an inner surface section, wherein the annular screen includes at least one swaged zone with the inner surface section of the annular screen abutting the outer surface of the tubular; and at least two deformable members mounted to the tubular between the first end and the second end, the at least two deformable members being selectively radially outwardly expandable relative to the at least one screen forming a plurality of screen compartments on the tubular, the plurality of screen compartments being substantially fluidically isolated from one another externally of the tubular, wherein the at least one screen extends between and abuts the at least two deformable members.

2. The screen assembly according to claim 1, wherein at least one of the at least two deformable members is mounted to the outer surface section of the annular screen.

3. The screen assembly according to claim 1, wherein the at least one of the at least two deformable members is arranged on the annular screen at the at least one swaged zone.

4. The screen assembly according to claim 1, wherein the at least two deformable members comprises portions of a deformable member extending between the first and second ends across all of the plurality of openings.

5. The screen assembly according to claim 4, wherein the portions of the deformable member define a plurality of passages that register with corresponding ones of the plurality openings.

6. The screen assembly according to claim 1, wherein the at least one screen includes a plurality of screen members arranged in corresponding ones of the plurality of openings.

7. The screen assembly according to claim 6, wherein the plurality of screen members comprises at least one of a welded mesh, sintered beads and consolidated gravel.

8. The screen assembly according to claim 1, wherein the at least two deformable members comprise at least three deformable members.

9. A resource exploration system comprising:

an uphole portion; and a downhole portion including a plurality of tubulars, and a screen assembly connected to one of the plurality of tubulars, the screen assembly comprising:

a tubular including a first end coupled to the one of the plurality of tubulars, a second end, and an intermediate portion including an outer surface provided with a plurality of openings extending therebetween;

an annular screen extending about the tubular and arranged at the plurality of openings, the annular screen including an outer surface section and an inner surface section, wherein the annular screen includes at least one swaged zone with the inner surface section of the annular screen abutting the outer surface of the tubular; and at least two deformable members mounted to the tubular between the first end and the second end, the at least two deformable members being selectively radially outwardly expandable relative to the at least one screen forming a plurality of screen compartments on the tubular, wherein the at least one screen extends between and abuts the at least two deformable members.

10. The resource exploration system according to claim 9, wherein at least one of the at least two deformable members is mounted to the outer surface section of the annular screen.

11. The resource exploration system according to claim 9, wherein at least one of the at least two deformable members is arranged on the annular screen at the at least one swaged zone.

12. The resource exploration system according to claim 9, wherein the at least two deformable member comprises portions of a deformable member extending between the first and second ends across all of the plurality of openings.

13. The resource exploration system according to claim 12, wherein the portions of the deformable member define a plurality of passages that register with corresponding ones of the plurality openings.

14. The resource exploration system according to claim 9, wherein the at least one screen includes a plurality of screen members arranged in corresponding ones of the plurality of openings.

15. The resource exploration system according to claim 14, wherein the plurality of screen members comprises at least one of a welded mesh, sintered beads and consolidated gravel.

16. A method of deploying a screen assembly comprising:

deploying a screen assembly including an annular screen extending about a tubular, the annular screen including an outer surface section and an inner surface section, wherein the annular screen includes at least one swaged zone with the inner surface section of the annular screen abutting the outer surface of the tubular;

expanding at least two deformable members radially outwardly relative to the at least one screen toward a formation, wherein the at least one screen extends between and abuts the at least two deformable members; and creating a plurality of screen compartments on the tubular with the at least two deformable members.

17. The method of claim 16, wherein creating the plurality of screen compartments includes creating a plurality of substantially fluidically isolated pockets externally of the tubular.

* * * * *